US009680203B2

(12) United States Patent
Liou et al.

(10) Patent No.: US 9,680,203 B2
(45) Date of Patent: Jun. 13, 2017

(54) ANTENNA STRUCTURE AND WIRELESS COMMUNICATION DEVICE

(71) Applicant: Chiun Mai Communication Systems, Inc., New Taipei (TW)

(72) Inventors: Geng-Hong Liou, New Taipei (TW); Yen-Hui Lin, New Taipei (TW)

(73) Assignee: Chuin Mai Communication Systems, Inc., New Taipei (TW)

( * ) Notice: Subject to any disclaimer, the term of this patent is extended or adjusted under 35 U.S.C. 154(b) by 293 days.

(21) Appl. No.: 14/141,677

(22) Filed: Dec. 27, 2013

(65) Prior Publication Data

US 2014/0340280 A1 Nov. 20, 2014

(30) Foreign Application Priority Data

May 14, 2013 (TW) ..... 102117119 A

(51) Int. Cl.
*H01Q 5/371* (2015.01)
*H01Q 1/24* (2006.01)

(52) U.S. Cl.
CPC ..... *H01Q 1/243* (2013.01); *H01Q 5/371* (2015.01)

(58) Field of Classification Search
CPC ..... H01Q 21/00; H01Q 5/371; H01Q 1/243
USPC ..... 343/702, 846
See application file for complete search history.

(56) References Cited

U.S. PATENT DOCUMENTS

2010/0231470 A1* 9/2010 Lee ..... H01Q 15/0086 343/722
2011/0136447 A1* 6/2011 Pascolini ..... H01Q 1/243 455/90.2

* cited by examiner

*Primary Examiner* — Graham Smith
*Assistant Examiner* — Noel Maldonado
(74) *Attorney, Agent, or Firm* — Steven Reiss

(57) ABSTRACT

An antenna structure includes a metal member, an extending section, and a metal sheet. The metal member defines a gap. The gap divides the metal member into a first portion and a second portion. The extending section is connected to the first portion of the metal ember to cooperatively form a first antenna. The first antenna, the metal sheet and the second portion of the metal portion cooperatively form a second antenna.

8 Claims, 1 Drawing Sheet

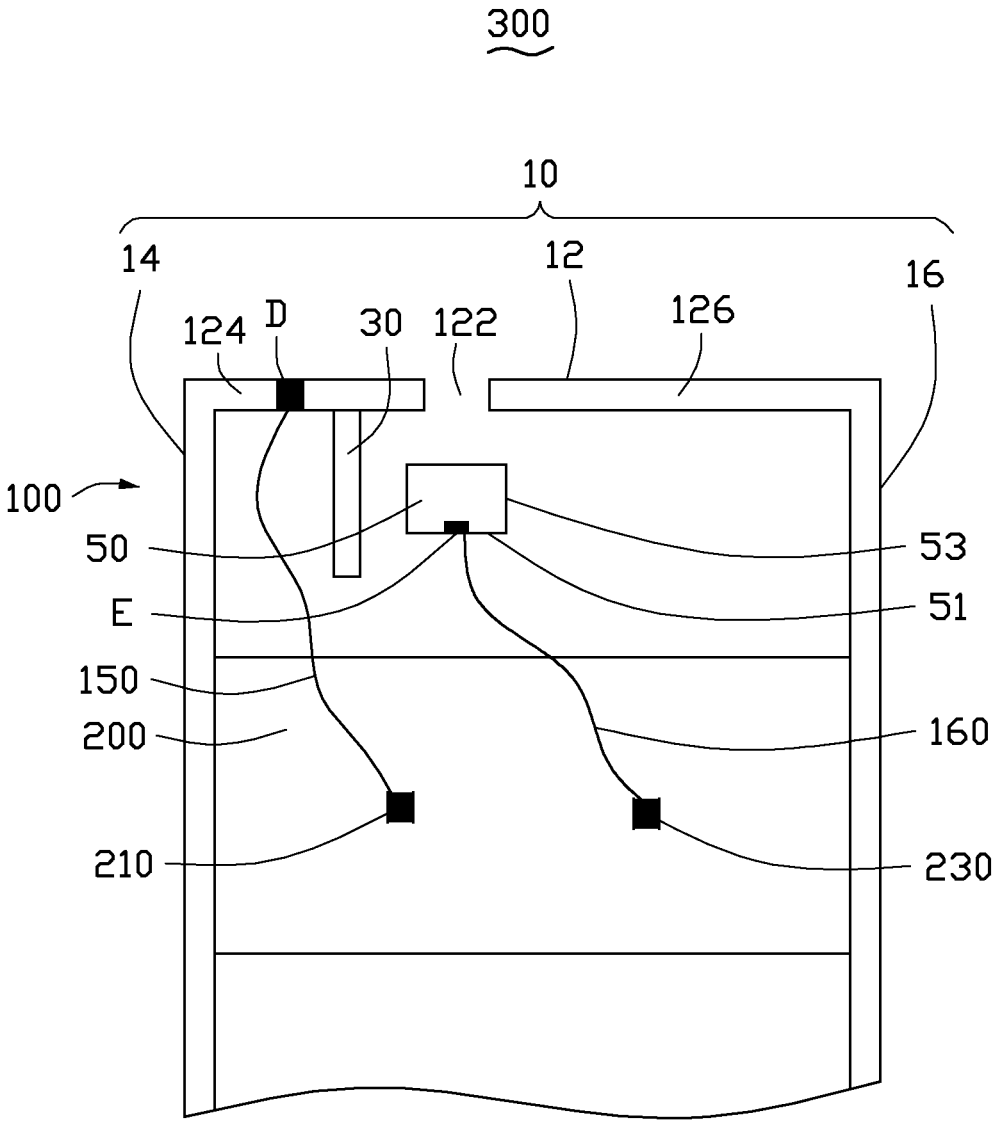
300
10
14
12
16
124
D
30
122
126
100
50
53
E
51
150
200
160
210
230

ANTENNA STRUCTURE AND WIRELESS COMMUNICATION DEVICE

BACKGROUND

1. Technical Field

The disclosure generally relates to antenna structures and wireless communication devices, and particularly to an antenna structure formed by a metal shell of a wireless communication device.

2. Description of Related Art

Metal shells are widely used in wireless communication devices because of the advantages of mechanical strength, resistance to deformation, and tactile sensation. However, the metal shells may shield and interfere with signals radiated by antennas of the wireless communications and negatively influences a radiation efficiency of the antennas.

Therefore, there is room for improvement within the art.

BRIEF DESCRIPTION OF THE DRAWING

Many aspects of the present disclosure can be better understood with reference to the following drawing. The components in the drawing are not necessarily drawn to scale, the emphasis instead being placed upon clearly illustrating the principles of the disclosure.

The FIGURE is a schematic view of a wireless communication device having an antenna structure, according to an exemplary embodiment of the disclosure.

DETAILED DESCRIPTION

The FIGURE is a schematic view of a wireless communication device 300 having an antenna structure 100, according to an exemplary embodiment of the disclosure. The wireless communication device 300 may be as a mobile phone, or a personal digital assistant, for example, and further includes a circuit board 200 (schematically shown). The circuit board 200 includes a feed point 210 and a ground point 230. The feed point 210 is configured to feed current for the antenna structure 100. The ground point 230 is configured to provide ground for the antenna structure 100.

The antenna structure 100 includes a metal member 10 (partially shown), an extending section 30, and a metal sheet 50.

The metal member 10 is an appearance element of the wireless communication device, such as a metal frame. In this embodiment, the metal member 10 is a frame structure, which includes, in part: a first frame leg 12, a second frame leg 14, and a third frame leg 16. The second frame leg 14 and the third frame leg 16 are respectively connected to two ends of the first frame leg 12. A gap 122 is defined in the first frame leg 12 adjacent to the second frame leg 14 dividing the first frame leg 12 to form a first panel portion 124 and a second panel portion 126 spaced from the first panel portion 124. The first panel portion 124 is connected to the second frame leg 14 to form a first portion of the metal member 10. The second frame leg 14 is secured to the circuit board 200 by a conventional mechanical securing way such as screwing and is electronically connected to the ground point 230 by a first screw (not shown). The first panel portion 124 includes a first connecting contact D. The connecting contact D is electronically connected to the feed point 210 by a connecting member 150 (e.g. a feed line, a probe, an elastic sheet). The extending section 30 is secured to an end of the first panel portion 124 by the conventional mechanical securing way such as soldering (not shown) and also parallel to the second frame leg 14. The first combing portion 124, the second metal frame 14, and the extending section 30 cooperatively form a first antenna operating at a first working mode to receive a first frequency band signal (e.g. a WIFI signal).

The second combing portion 126 is connected to the third frame leg 16 to form a second portion of the metal member 10. The third frame leg 16 is secured to the circuit board 200 by the conventional mechanical securing way such as screwing and also electronically connected to the ground point 230 by a second screw (not shown). The metal sheet 50 includes a second connecting contact E. The second connecting contact E is electronically connected to the ground point 230 by the connecting member 160 (e.g. a feed line, a probe, an elastic sheet) The metal sheet 50 can be positioned at a housing of the wireless communication device. In this embodiment, the metal sheet 50 is a rectangular sheet including two opposite first edges 51 and two opposite second edges 53 shorter than the first edges 51. One of the first edges 51 faces to the gap 122 and is opposite to and parallel with the first frame leg 12. One of the second edges 53 is parallel to and spaced from the extending section 30. Thus, the first frame leg 12, the extending section 30 and the metal sheet 50 generate a coupling and resonance effect so that the first antenna, the second panel portion 126, the third frame leg 16, and the metal 50 cooperatively serve as a second antenna. The second antenna operates a second working mode to receive and transmit a second frequency band signal (e.g. a GPS signal).

In use, the current is fed into the first connecting point D from the feed point 210 by the connecting member 150. A first portion of the current flows through the extending section 30. A second portion of the current flows through the second frame leg 14. The first potion and the second portion of the current finally flow into the ground point 230 by the ground point 230 to form a first antenna path.

On another aspect, a third portion of the current flowing to a distal end of the first panel portion 124 also is coupled to the second panel portion 126 and finally flows into the ground point 230 via the third frame leg 16. Meanwhile, the current flowing though the extending section 30 also is coupled to the metal sheet 50, and then flows through the second panel portion 126 and finally flows into the ground point 230 via the third frame leg 16. In addition, current fed into the metal sheet 50 from the circuit board 200 also is coupled to the second panel portion 126 and finally flows into the ground point 230 via the third frame leg 16. Thus, the first panel portion 124, the metal sheet 50, the second panel portion 126, and the third frame leg 16 cooperatively form a second antenna path.

The antenna structure 100 divides the metal member 10 into the first portion and the second portion by the gap 122 defined in the metal member 10 so that bandwidths of the first antenna and the second antenna can be adjusted by changing a position of the gap 122. For example, when the position of the gap 122 is adjacent to the third metal frame 16, a length of the first antenna path is lengthened so that a central frequency of the first frequency band becomes low. Meanwhile, a length of the second antenna path is shortened so that a central frequency of the second frequency band becomes high. Thus, the frequency band of the antenna structure 100 can be flexiblely changed.

The metal member 10, the extending section 30, and the metal sheet 50 are spaced from each other. Meanwhile, the wireless communication device 300 integrates the metal member 10 as a portion of the antenna structure 100 to avoid the metal member 10 from negatively influencing radiation efficiency of the antenna structure 100.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna structure, comprising:

a metal member being a frame structure and comprising a first frame leg, a second frame leg and a third frame leg, the first frame leg comprising two ends, wherein the second frame leg perpendicularly connects to one end of the first frame leg and the third frame leg perpendicularly connects to the other end of the first frame leg, and wherein the first frame leg defines a gap, the gap divides the first frame leg into a first panel portion and a second panel portion, spaced apart from the first panel portion, the first panel portion connects to the second frame leg to form a first portion, and the second panel portion connects to the third frame leg to form a second portion;

an extending section perpendicularly connected to one side of the first panel portion where the second frame leg is positioned, the extending section being parallel to the second frame leg, wherein the first panel portion, the second frame leg, and the extending section together form a first antenna; and a metal sheet, wherein the first antenna, the metal sheet, and the second portion of the metal member together form a second antenna.

2. The antenna structure of claim 1, wherein the metal sheet comprises two opposite first edges and two opposite second edges, one of the first edges faces the gap, one of the second edges is parallel to and spaced apart from the extending section, the extending section and the metal sheet generate a coupling and resonance effect.

3. The antenna structure of claim 1, wherein the first panel portion comprises a first connecting point adjacent to an end of the second frame leg to feed current to the antenna structure, wherein when the current is fed into the first connecting point, a first portion of the current flows through the extending section, and a second portion of the current flows through the second frame leg, wherein the extending section and the second frame leg together form a first antenna path.

4. The antenna structure of claim 3, wherein a third portion of the current flowing to a distal end of the first panel portion flows through the second panel portion and finally flows into the ground point through the third frame leg; the current flowing though the extending section flows through the metal sheet, and then flows through the second panel portion, and finally flows into the ground point through the third frame leg; wherein the current fed into the metal sheet from the circuit board also flows through the second panel portion and finally flows into the ground point through the third frame leg; and wherein the first panel portion, the metal sheet, the second panel portion, and the third frame leg together form a second antenna path.

5. A wireless communication device, comprising:

a circuit board, the circuit board comprising a feed point and a ground point;

an antenna structure connected to the feed point and the ground point, the antenna structure comprising:

a metal member, the metal member being a frame structure and comprising a first frame leg, a second frame leg and a third frame leg, the first frame leg comprises two ends, wherein the second frame leg perpendicularly connects to one end of the first frame leg and the third frame perpendicularly connects to the other end of the first frame leg, and wherein the first frame leg defines a gap, the gap divides the first frame leg into a first panel portion and a second panel portion, spaced apart from the first panel portion, the first panel portion connects to the second frame leg to form a first portion, and the second panel portion connects to the third frame leg to form a second portion;

an extending section, the extending section perpendicularly connected to one side of the first panel portion where the second frame leg is positioned, the extending section being parallel to the second frame leg, wherein the first panel portion, the second frame leg, and the extending section together form a first antenna; and a metal sheet, wherein the first antenna, the metal sheet, and the second portion of the metal member together form a second antenna.

6. The wireless communication device of claim 5, wherein the second frame leg and the third frame leg are electronically connected to the ground point, the metal sheet comprises two opposite first edges and two opposite second edges, one of the first edges faces the gap, one of the second edges is parallel to and spaced apart from the extending section, the extending section and the metal sheet generate a coupling and resonance effect.

7. The wireless communication device of claim 5, wherein the first panel portion comprises a first connecting point adjacent to an end of the second frame leg connected to the feed point, wherein when the current is fed into the first connecting point, a first portion of the current flows through the extending section and a second portion of the current flows through the second frame leg, wherein the extending section and the second frame leg together form a first antenna path.

8. The wireless communication device of claim 7, wherein a third portion of the current flowing to a distal end of the first panel portion flows through the second panel portion and finally flows into the ground point through the third frame leg; wherein the current flowing though the extending section flows through the metal sheet, and then flows through the second panel portion and finally flows into the ground point through the third frame leg; current fed into the metal sheet from the circuit board also flows through the second panel portion and finally flows into the ground point through the third frame leg; and wherein the first panel portion, the metal sheet, the second panel portion, and the third frame leg together form a second antenna path.

* * * * *